US005611155A

United States Patent [19]

Brown et al.

[11] Patent Number: 5,611,155

[45] Date of Patent: Mar. 18, 1997

[54] ELASTOMETRIC CONNECTING MEANS FOR FOOTWEAR

[75] Inventors: Roger J. Brown; Erik O. Giese, both of Aspen; Michael D. Racosky, Boulder, all of Colo.

[73] Assignee: Comfort Products, Ltd., Aspen, Colo.

[21] Appl. No.: 270,853

[22] Filed: Jul. 5, 1994

[51] Int. Cl.[6] ..... A43B 5/04; A43B 5/16

[52] U.S. Cl. ..... 36/118.2; 36/115; 36/118.3; 36/118.9

[58] Field of Search ..... 36/115, 117, 118, 36/119, 120, 121

[56] References Cited

U.S. PATENT DOCUMENTS

| | | | |
|---|---|---|---|
| 4,777,742 | 10/1988 | Petrini et al. | 36/120 |
| 5,068,984 | 12/1991 | Kaufman et al. | 36/120 X |
| 5,088,211 | 2/1992 | Wauchoff | 36/120 X |
| 5,142,798 | 9/1992 | Kaufman et al. | 36/120 X |
| 5,212,893 | 5/1993 | Pozzobon | 36/120 |
| 5,297,350 | 3/1994 | Stampaccia et al. | 36/120 |

FOREIGN PATENT DOCUMENTS

| | | |
|---|---|---|
| 1485766 | 8/1971 | Germany . |

*Primary Examiner*—Bryon P. Gehman
*Assistant Examiner*—BethAnne C. Dayoan
*Attorney, Agent, or Firm*—Pennie & Edmonds

[57] ABSTRACT

A boot having a shoe shaped shell member and a cuff member having a section overlapping the shell member. The cuff and shell members are pivotally connected together for pivoting movement in response to pivoting of the individual's leg relative to the individual's foot. An elastomeric material is disposed between said shell member to pivotally connect the two members together.

21 Claims, 14 Drawing Sheets

FIG. 6
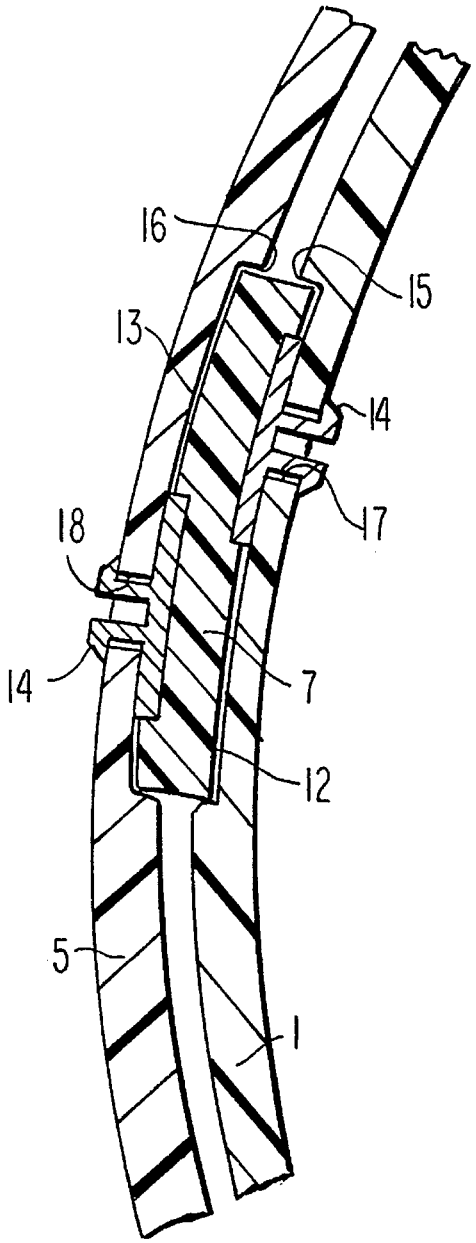
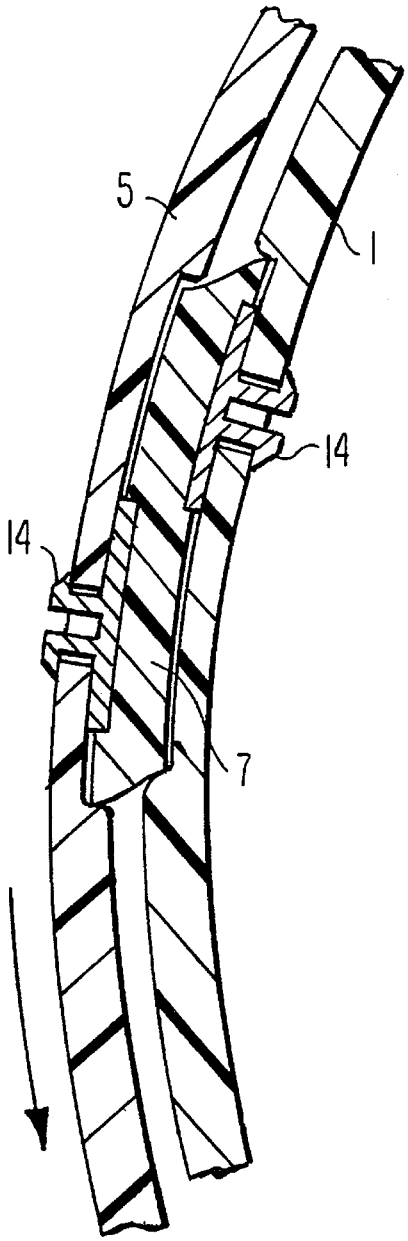
FIG. 7

FIG. 8
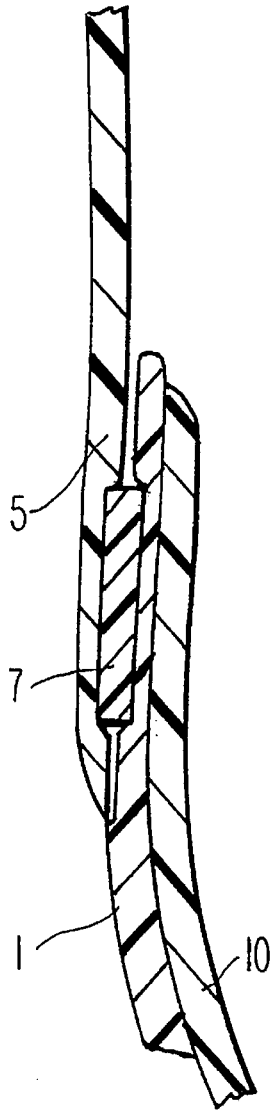
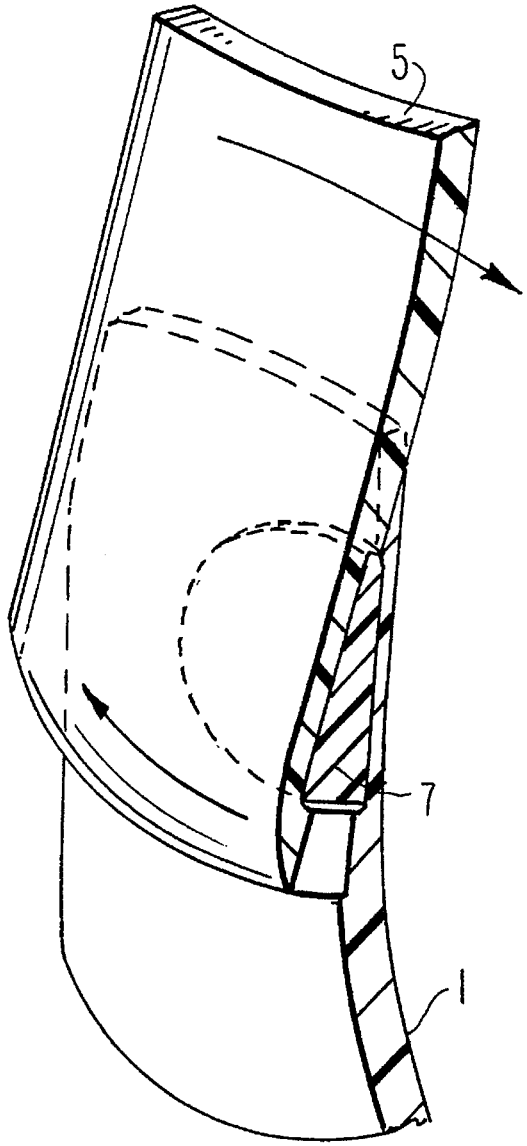
FIG. 9

1
2
3
4
7
8
9
30
31
32
33
34
35
36
37
38
39
40
41
42
43

ELASTOMETRIC CONNECTING MEANS FOR FOOTWEAR

TECHNICAL FIELD

The invention relates to a means of attaching footwear parts together with an elastomeric material permitting relative movement between those parts to accommodate movements of the foot.

BACKGROUND OF THE INVENTION

Plastic footwear such as ski boots and boots for skates, collectively referred to herein as boots, are usually comprised of two, three or four parts necessary to permit flexing of the ankle forward and backwards while retaining lateral support for performance. These plastic parts are normally connected with metal rivets, permitting swiveling or rotation around the location of the rivets. Plastic is commonly used and the parts are formed by such methods as injection molding. The boot provides protection to the foot and lower leg and adds sufficient stiffness to permit good performance such as in ski boots where lateral support is necessary for various ski maneuvers.

It is necessary when skiing or skating to permit the skier or skater to bend his or her knees in the forward direction and to encounter various resistance as the knee is bent further forward, eventually coming to a stop, before damage occurs to the Achilles tendon. This requires fairly precise fit of the plastic pieces and careful placement of rivets or other pivoting means to provide for comfort and performance at the same time.

Normally a boot of the above described type has a lower shell having a heel, middle and front section for receiving and supporting an individual's foot along the heel, bottom, sides and top front portion of the foot. The boot may also include a cuff which covers the upper portion of the foot or lower leg. The cuff is the part which rotates forward when the knee is bent. Additionally, many boots have tongues or rear portions which permit exit and entry in the case of front-entry or rear-entry boots.

Conventionally constructed boots utilizing rivets are limited in that the cuff or other plastic parts attached to the lower shell must rotate around a fixed point. This is not necessarily compatible with the human foot, which has a semi-sliding joint in the ankle rather than one which pivots from a point between the ankle bones.

SUMMARY OF THE INVENTION

It is, therefore, an object of the invention to provide a boot construction which will allow the plastic parts to slide back and forth, in addition to rotation, in order to accommodate the anatomical characteristics of the ankle joint and movement of the lower leg.

It is a further object to provide for various forward and rear flex resistance by releasably connecting the plastic parts together through the use of interchangeable elastomeric materials.

It is also an object of the invention to permit the use of low cost plastics for the shell and cuff parts and to reduce the criticality of the flex characteristics of the plastic.

It is still a further object of the invention to provide for a boot construction which is shock absorbing in various directions, as well as to provide a spring-back effect tending to return the foot to the normal position with respect to a ski or skate boot when bending forces are removed.

It is still a further object of the invention to provide for a boot construction to eliminate significant bow or bulge effect occurring in various parts of the boot when the wearer's leg is bent forward, thus aiding lateral support and providing a comfortable fit.

Generally, a boot constructed according to the invention comprises a relatively stiff outer shell covering the lower part of the foot, and an upper portion or cuff surrounding the upper part of the foot or lower leg of the wearer. A soft inner boot is positioned in the shell and is adapted to engage the foot of the wearer. The cuff and shell, or other plastic parts are connected to each other with an elastomeric material which is bonded or otherwise fastened to the various plastic parts. The elastomeric material permits relative movement between the plastic parts due to the shear quality of the material, in addition to stretching or compressing of the elastomeric material in all directions. The flexing of the boot incorporating the elastomeric material provides a degree of spring-back tending to return the foot and leg to the normal unbent position when bending forces are removed. Most importantly, the natural flex characteristics of the ankle are enhanced by particular placement of the elastomeric connecting material to the plastic parts surrounding the foot and lower leg.

In one embodiment of the invention the elastomeric material is in the form of two round discs, one on either side of the foot, connecting the lower shell to the upper cuff. The material may be molded in place, connected to the plastic parts by adhesive, ultrasonically welded or may contain snap-fit protruding pieces which will fit into corresponding recesses or apertures in the respective plastic parts.

In a further embodiment of the invention, the elastomeric connecting material has particular shapes and even cut outs or holes in it to provide various flex characteristics and relative movement for the various plastic boot parts.

In a further embodiment of the invention, the elastomeric material may connect plastic parts in both front-entry and rear-entry boots by proper placement of the connecting parts of the lower shell, cuff and other plastic parts comprising the boot. Interchangeability of the elastomeric connecting material is also possible, thus permitting the wearer to change the flex characteristics of the boot by simply snapping out and in a harder or softer piece of elastomeric material.

BRIEF DESCRIPTION OF THE DRAWINGS

FIGS. 6–14 are partial cross-sectional views showing different ways of attaching the elastomeric material to the respective parts of the boot.

DETAILED DESCRIPTION OF THE INVENTION

Figure 1:
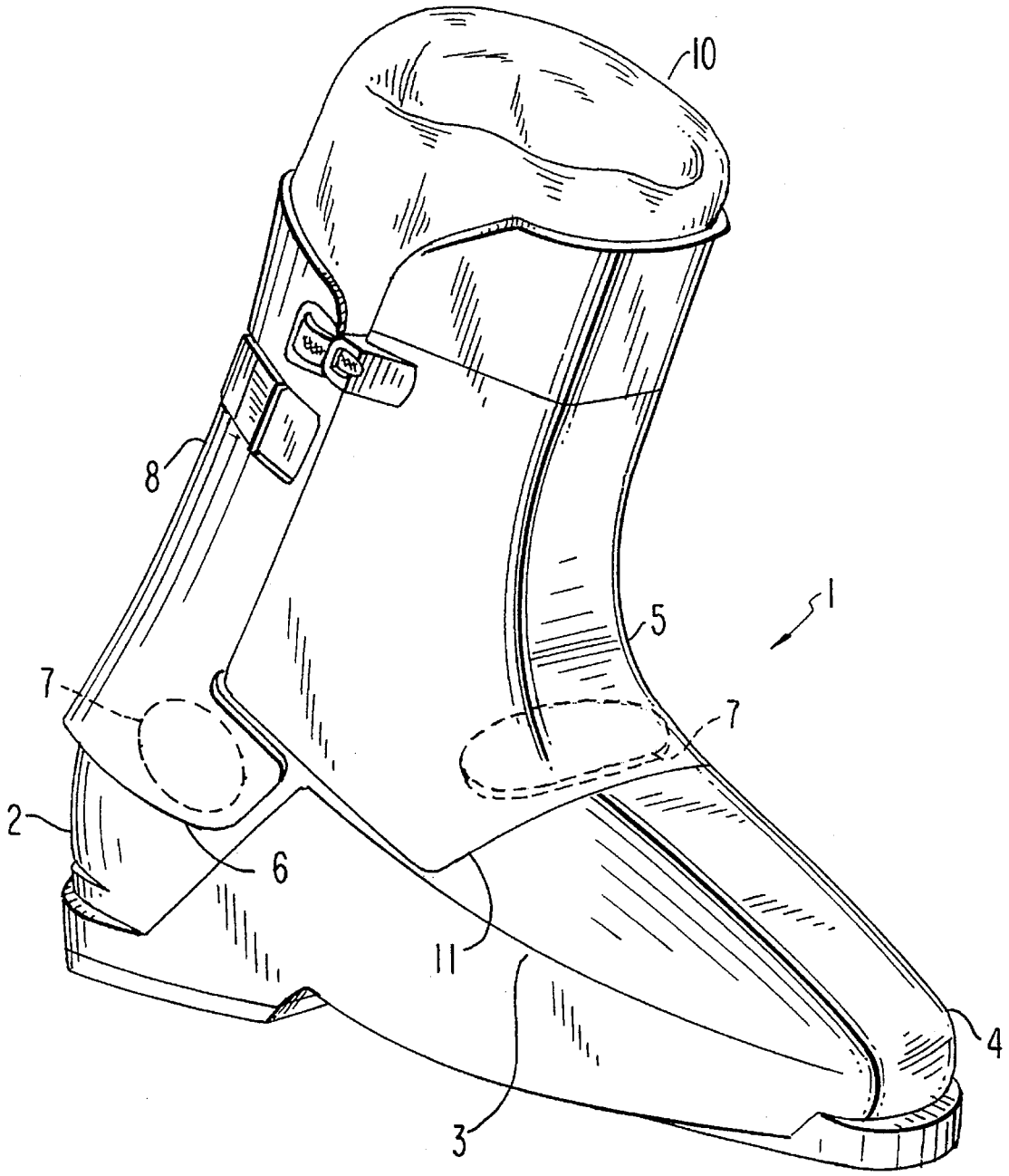
FIG. 1 is a perspective view of one embodiment of the invention.

FIG. 1 shows an embodiment of the invention as incorporated into a ski boot. The boot includes a shell member 1 having a heel portion 2, a middle portion 3, and a front portion 4 for receiving and supporting an individual's foot along at least the bottom, sides, and front top portions of the foot. The boot further includes a cuff member 5 having overlapping sides sections 6 only one of which is shown in the drawings. The overlapping sections 6 extend on either side of the shell 1 in the area of the ankle bone of the individual's foot. The cuff member extends upwardly from the shell member for covering a portion of the individual's leg and is pivotally connected to the shell member for pivoting movement in response to the pivoting of the individual's leg relative to the individual's foot. The pivoting of the cuff member 5 to the shell 1 is, in accordance with the teachings of the present invention, effected by attaching means in the form of elastomeric material 7.

The boot of the embodiment of FIGS. 1–4 is completed by a back cuff member 8 which is pivoted to the heel portion 2 of the shell by a conventional rivet 9. Finally, disposed internally of the shell and cuff structure of the boot is an inner boot 10.

In the embodiment of the invention shown in FIGS. 1–4 the elastomeric material is disposed in the overlapping side sections of the cuff member and also in the overlapping front section 11 of the cuff member which extends toward the front portion 4 of the shell 1. Although not shown in FIGS. 1–4, there would be an elastomeric material on the hidden side of the cuff member where it overlaps with the shell of the boot.

Figure 5:
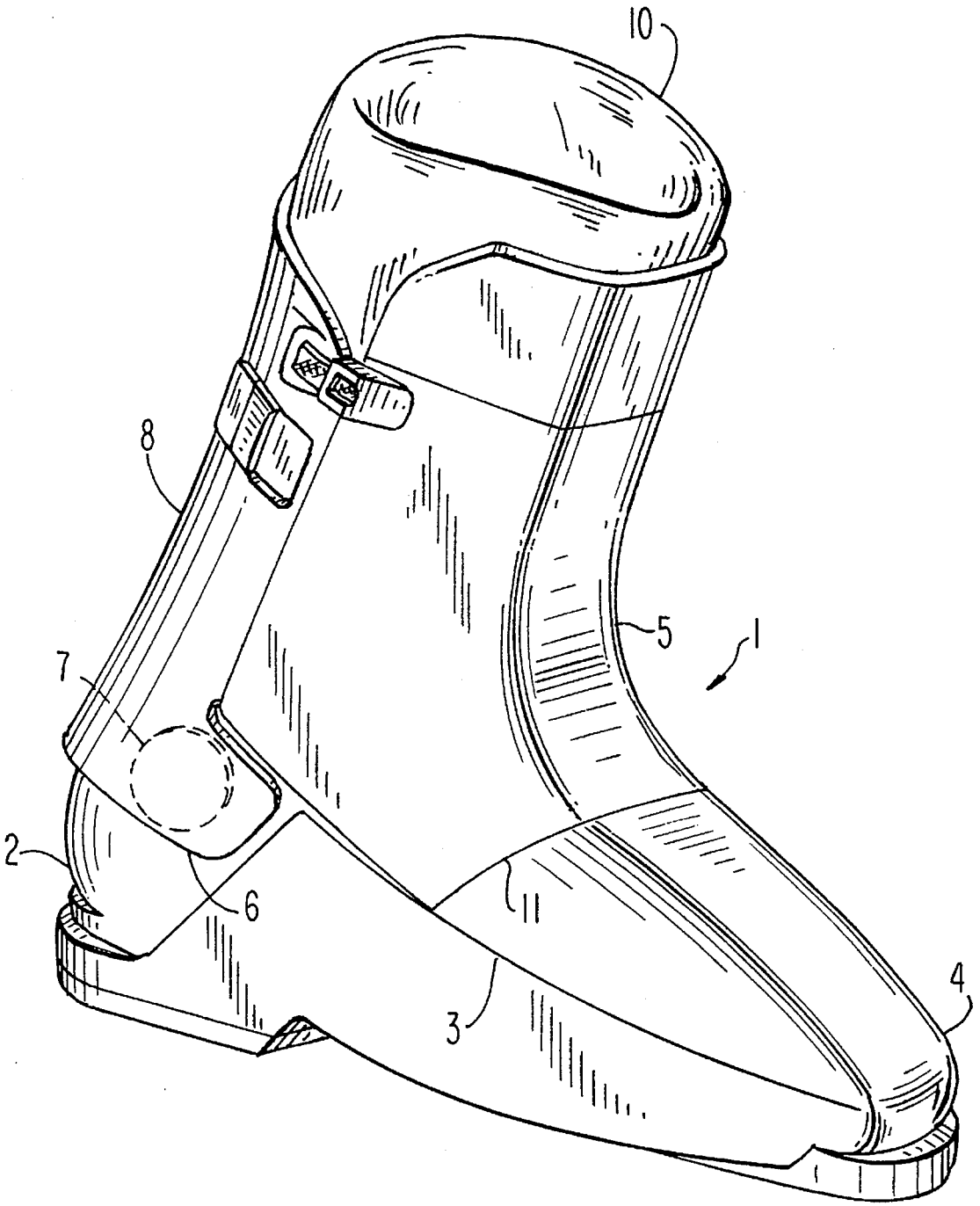
FIG. 5 is a perspective view of another embodiment of the invention similar to that of FIG. 1.

The boot construction shown in FIGS. 1–4 includes three elastomeric materials for connecting the cuff member to the shell member. However, the middle elastomeric material at the forward section of the cuff can be eliminated, leaving elastomeric material only in the side overlapping sections of the cuff and shell member. Such a construction is shown in FIG. 5. Alternatively, the overlapping side sections of the cuff and shell members can be connected by conventional rivets and the elastomeric material disposed only at the forward section of a cuff member.

Figure 2:
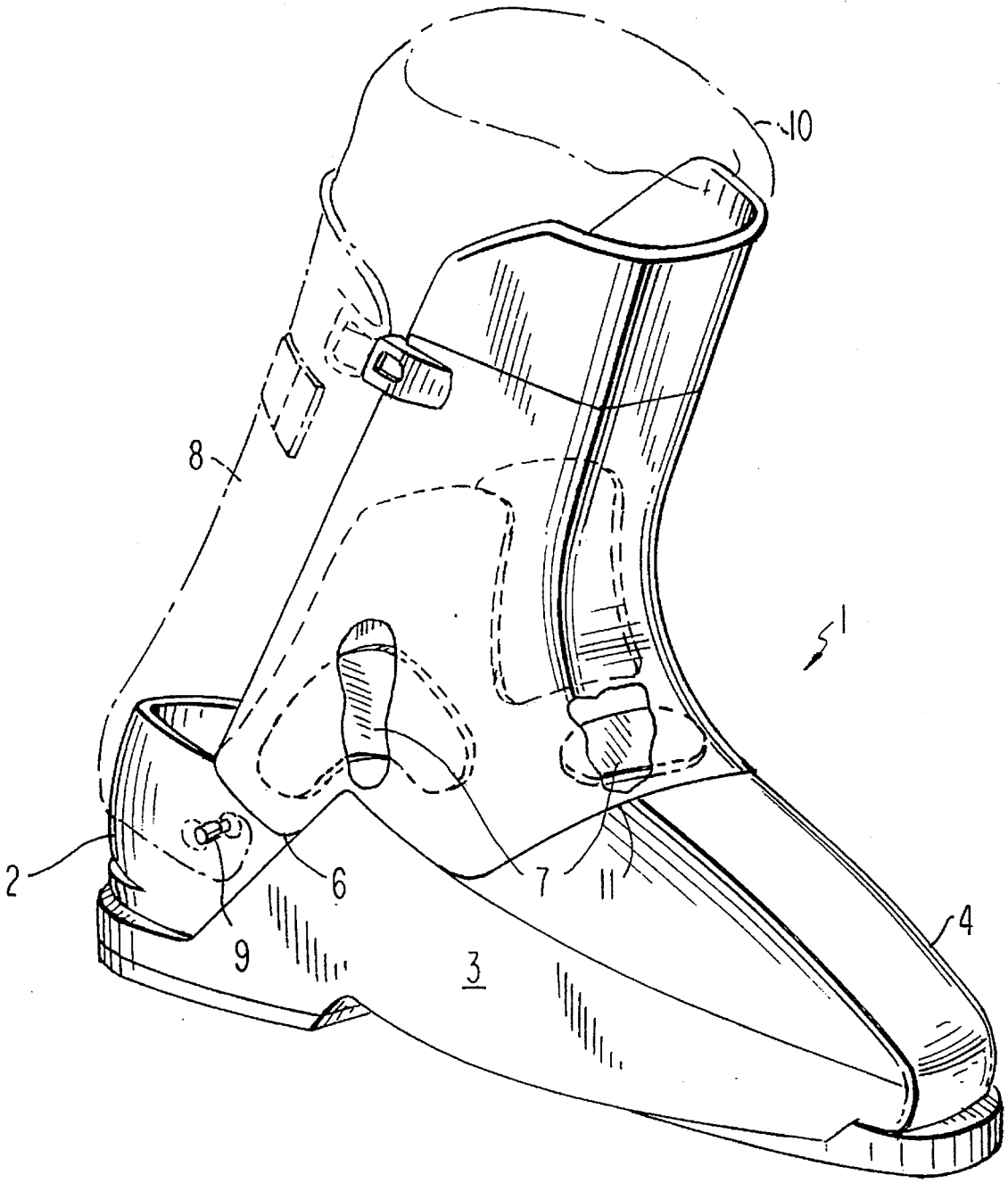
FIG. 2 is a perspective view of another embodiment of the invention using a different shape of elastomeric material.
Figures 3, 4:
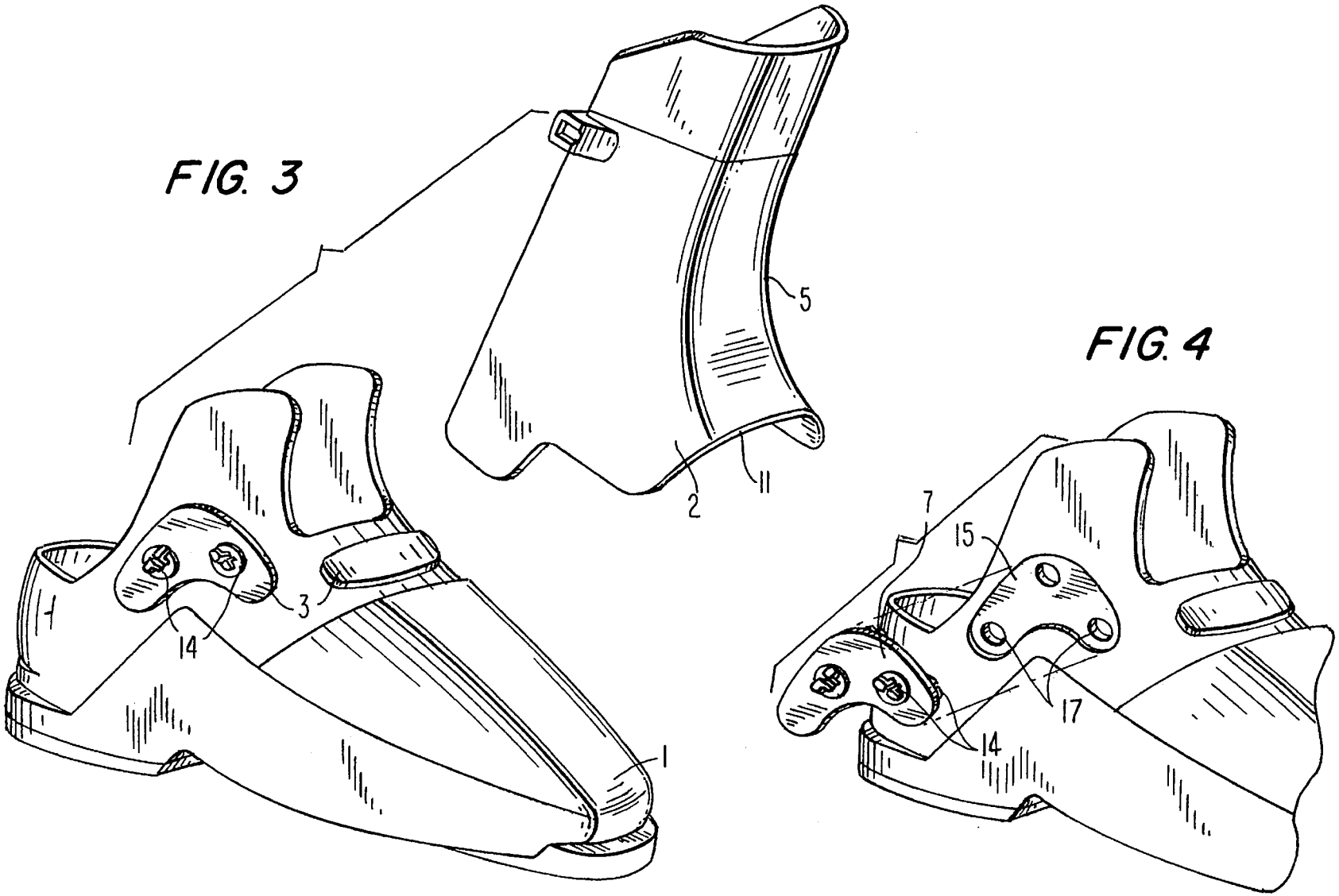
FIG. 3 is an exploded view of the embodiment of FIG. 2 showing the cuff member in relation to the shell member of the boot.
FIG. 4 is exploded view of the shell member and elastomeric material used in the embodiment of FIG. 2.

FIGS. 2–4 show the elastomeric material in the overlapping side sections of a cuff member as L-shaped with one leg of the L extending toward the heel of the boot and the other leg of the L extending toward the front portion of the shell. Different shapes of elastomeric material are possible. For example, FIGS. 1 and 5 show a simpler circular disk-shaped elastomeric material which is presently preferred.

The elastomeric material used to connect the shell and cuff members together has opposite first and second sides with the first side facing the surface of the shell member and the second side facing the surface of the cuff member. The thickness of the material as measured between the first and second sides is a fraction of the distance laterally across either of the sides.

In accordance with the teachings of the present invention, the elastomeric material includes physical characteristics permitting the first and second sides to rotate and shift laterally with respect to each other during pivoting of the cuff member on the shell member. In this way, the elastomeric material defines a floating pivot for the pivoting of the cuff member. In the broader sense, the elastomeric material is a rubber-like material having broad performance characteristics over a wide temperature range. As for example from minus 20° to 110° F.

Materials that will perform under these conditions will be, for example, but not limited to, polyether polyurethanes, polyester polyurethanes, rubbers, thermoplastic urethanes, thermoplastic elastomers, any copolymer of these or other materials, and any other such elastomeric material that can be cast, compression molded, injection molded, extruded or any other type of manufacturing process. The materials may also use a form of reinforcing such as, but not limited to, fibers, cloths, or fillers.

The elastomeric materials used may or may not require crosslinking to perform over the required temperature range while maintaining the required physical properties.

The chemicals that are selected for the elastomeric material need to have both physical and dynamic characteristics to perform adequately. The physical properties define the material "toughness". The rebound, ultimate elongation, and compression set all contribute to the "flex" characteristic of the boot. As these particular properties vary, the performance of the boot will change. The ultimate tensile and split/tear is required to minimize a material failure over the temperature range of operation.

For the ski boot application, a polyether polyurethane is presently preferred for its ease of manufacturing and its physical and dynamic characteristics. Polyester urethanes, copolymers and other materials that exhibit similar characteristics may also be used with similar results.

It is important to select the proper elastomeric material for the specific application. A ski boot may require a certain physical and dynamic property to perform properly. On the other hand, an in-line skate may require a material that has broader physical and dynamic properties due to the higher temperature range of operation.

The presently preferred elastomeric material is, as stated above, a polyether polyurethane. The components of the particular material used for a ski boot application has the following physical properties.

| | Ranges | Preferred Embodiment |
|---|---|---|
| Durometer | 30–85 Shore A | 49 Shore A |
| Bayshore Rebound | 30–85% | 75% |
| Split Tear | 15–200 psi | 45 psi |
| 100% Modulus | 50–1000 psi | 192 psi |
| 300% Modulus | 100–3000 psi | 224 psi |
| 500% Modulus | 150–5000 psi | 256 psi |

-continued

| | Ranges | Preferred Embodiment |
|---|---|---|
| Ultimate Tensile | 1000–5500 psi | 1280 psi |
| Ultimate Elongation | 200–800% | 750% |
| Compression Set | 1–50% | 30% |

The specific material used for the ski boot application is an isocyanate terminated urethane prepolymer. The prepolymer (also referred to as the A-side) composition is diphenylmethane di isocyanate (MDI) and a high molecular weight polytetramethylene ether glycol (PTMEG). The B-side composition is a high molecular weight polytetramethylene ether glycol (PTMEG) mixed with a tri-functional curative.

The PTMEG in the formulation provides the soft resilient segment that directly effects the physical and dynamic properties. The tri-functional curative assists in the split/tear and the dynamic performance.

The mix ratio of the A and B side materials in the preferred embodiment is 0.42 grams A-side to 1.000 grams B-side. Depending upon the desired material characteristics, the formulation and subsequent mix ratio will vary.

In accordance with the invention, the connection of the first and second sides of the elastomeric material to the shell and cuff members respectively is effected so that the first and second sides of the material can move relative to each other in a direction extending along the surfaces of the shell and cuff members to which the material is connected.

The construction of the elastomeric material and the connecting means for connecting it to the overlapping sections of the shell and cuff members are shown in FIGS. 6–11. In these figures, the first side of the elastomeric material facing the shell member 1 is designated by reference number 12 whereas the second side of the elastomeric material facing the cuff member is designated by reference number 13.

As shown in FIG. 6 the elastomeric material can be provided on its opposite first and second sides with connecting means in the form of snap members 14. The snap members are bonded by adhesive or other suitable means to the opposite sides of the elastomeric material. The construction of the connecting means shown in FIG. 6 is that which is used in the embodiments of the invention of FIGS. 1–5. As seen in FIGS. 3 and 4, three separate snap connectors are used to attach the elastomeric material to the shell member whereas two snap connectors are used to connect the elastomeric material to the cuff member 5. As shown in FIG. 6, both the shell member and the cuff member include a recess 15, 16, respectively, in the surface thereof for receiving the elastomeric material. In addition, the shell and cuff members include apertures 17, 18, respectively, for receiving the snap connectors 14 so as to hold the elastomeric material in place between the overlapping sections of the cuff and shell members.

Due to the physical characteristics of the elastomeric material, the cuff member of the boot can now pivot on the shell member upon a floating axis. In other words, the opposite first and second sides of the elastomeric material can shift laterally and rotate simultaneously with respect to each other during pivoting of the cuff member. Such movement of the elastomeric material is shown in FIG. 7.

FIG. 8 shows a construction in which the elastomeric material is bonded to the shell and cuff members. FIG. 9 shows the embodiment of FIG. 8 under stress. In FIG. 9, the cuff member has been pivoted forwardly with the top portion also being moved inwardly. This causes the elastomeric material to take the shape shown in FIG. 9 and thus accommodate the movement of the individual's leg.

Figure 10:
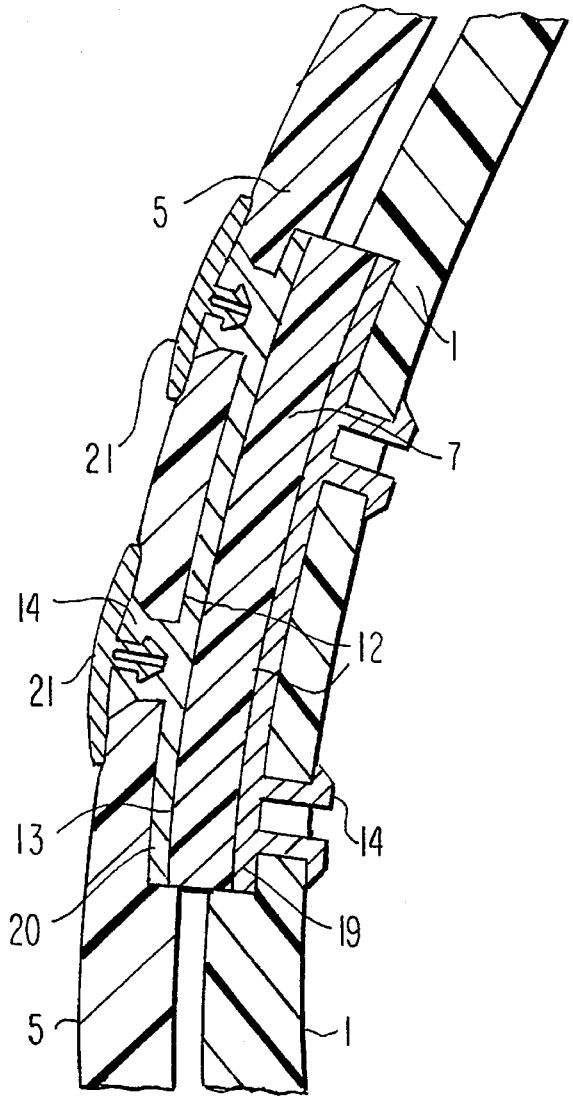

In FIG. 10, the elastomeric material is bonded between two plate members 19 and 20. These plate members have a predetermined stiffness no greater than the stiffness of the shell and cuff members. In the embodiment of FIG. 10, the snap members are formed integrally with the plate members. Also the outer snap members are provided with covers 21 for aesthetic purposes. The cover members may include the logo of the boot manufacturer.

Figure 11:
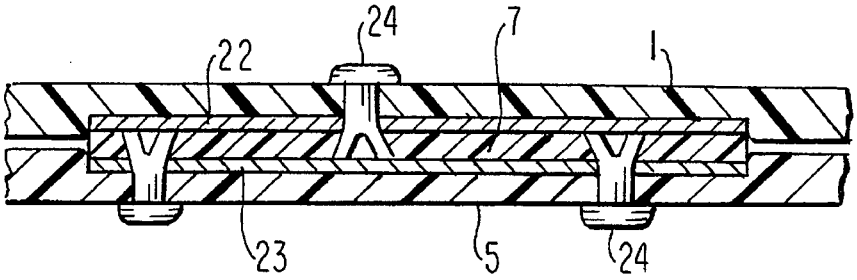

FIG. 11 shows a construction in which the elastomeric material 7 is bonded between two plate members 22, 23 having apertures for receiving connecting means in the form of push rivet connectors 24 having splayed ends extending into the elastomeric material. The connectors extending in from one side of the elastomeric material are spaced from the connectors extending through the other side. The connectors are inserted through the shell and cuff members after the parts have been assembled. In the construction shown in FIG. 11, the elastomeric material has a thickness of 3.5 mm while the plate members have a thickness of 2 mm. The plate members are made of rigid polyurethane.

Figure 12:
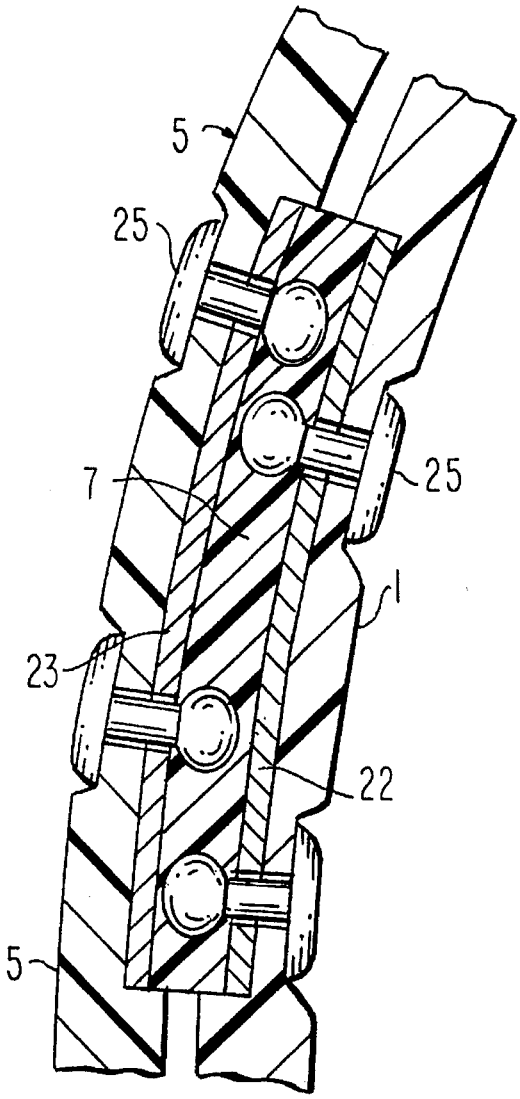

FIG. 12 shows another embodiment similar to that shown in FIG. 11. The connectors are, however, of a different construction. In the embodiment of FIG. 12, they take the form of pop rivets rather than the form of the push rivets of the embodiment of FIG. 11.

Figure 13:
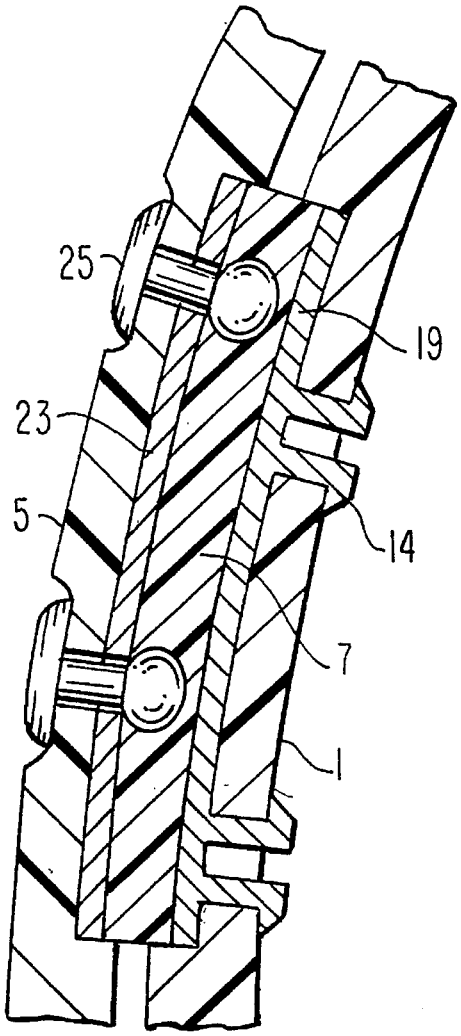

The embodiment of FIG. 13 is a hybrid of the embodiments of FIGS. 10 and 12. A plate 19 containing integrally formed snap members 14 is bonded to the inside surface of the elastomeric material. On the outside surface of the elastomeric material, an apertured plate 23 is bonded and pop rivets 25 are used.

Figure 14:
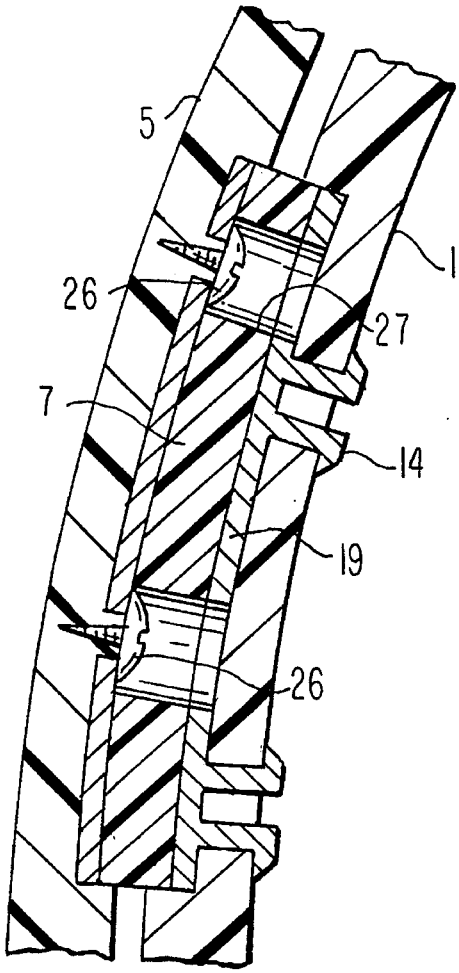

The embodiment of FIG. 14 shows still another means of attaching the elastomeric material between the inner shell 1 and outer cuff member 5. In this construction, the connection to the outer cuff member is effected by screws 26. To permit attachment by the screws, the back plate member 19 and elastomeric material is provided with appropriate apertures at 27. After attachment of the elastomeric material to the outer cuff member 5, this sub assembly is snapped onto the inner shell by means of the snap member 14.

Figure 15:
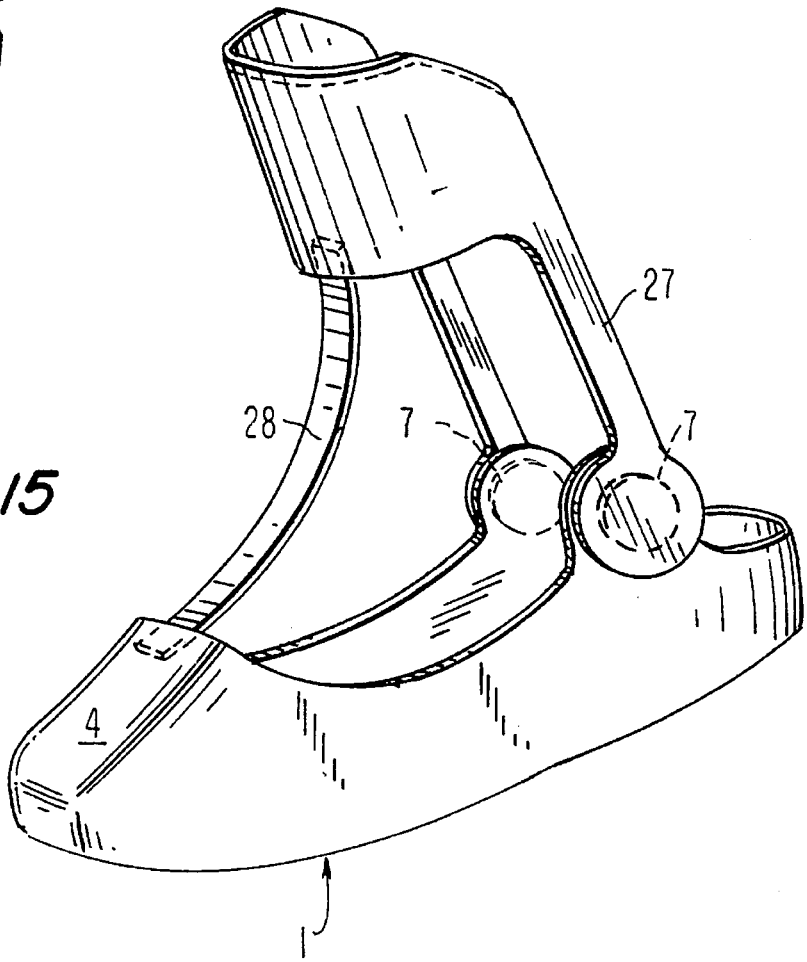
FIG. 15 is a perspective view of an embodiment of the invention using an exoskeletal cuff member.

FIG. 15 shows another configuration of the invention. In this construction, an exoskeletal cuff member 27 is employed. This cuff member is attached to the shell member 1 by means of the elastomeric material 7. As shown, the elastomeric material is disc shaped and provided on opposite sides of the shell in alignment with the individual's ankle. The elastomeric material permits the cuff member 27 to rotate forward with respect to the shell. The front top of the exoskeletal cuff is connected to the front portion 4 of the boot by means of a flexible strap 28.

Figure 16:
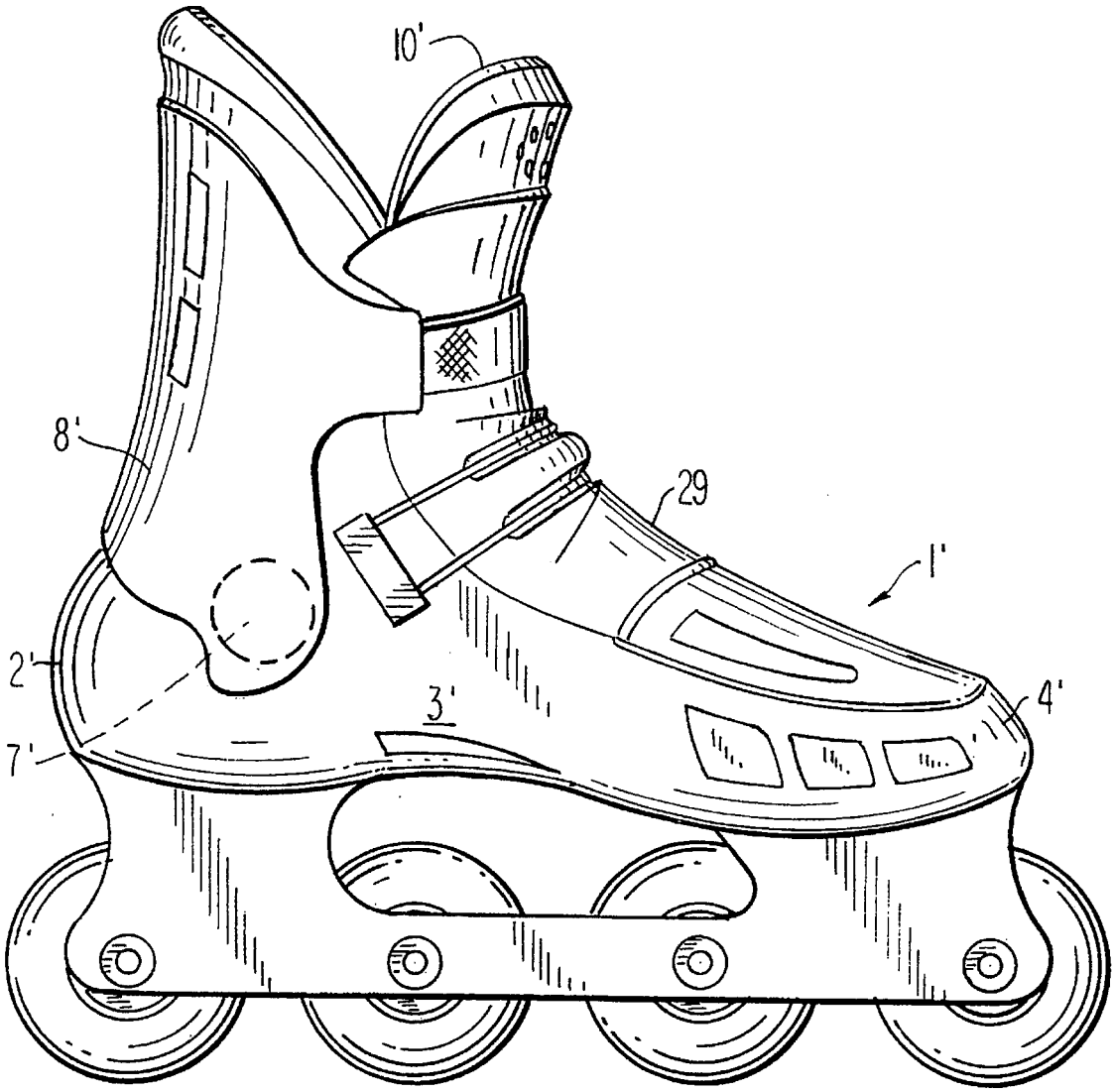
FIG. 16 is a perspective view of the invention as employed in an in-line skate.
Figure 17:
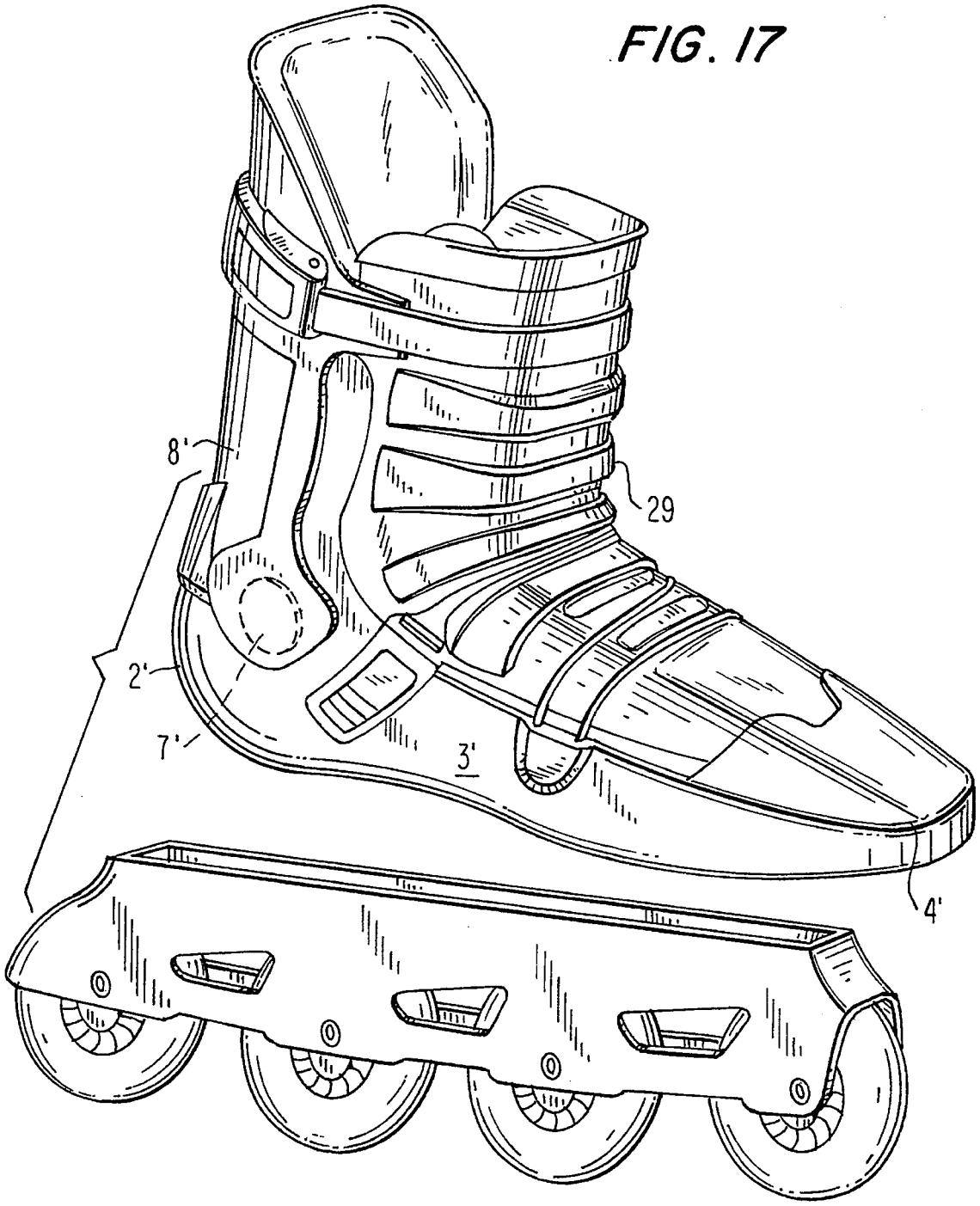
FIG. 17 is an exploded view of the in-line skate construction of the invention with a different tongue section than that used with the embodiment of FIG. 16.

An in-line skate employing the teachings the present invention is shown in the embodiments of FIGS. 16 and 17. Parts of the in-line skate of FIG. 16 corresponding to parts of the ski boot of FIGS. 1–4 are designated by use of the same reference numerals followed by the prime sign. As shown, the rear cuff member 8' is connected to the shell 1' by means of the elastomeric material 7'. The boot construction for the in-line skate also includes a front tongue member 29.

Figure 18:
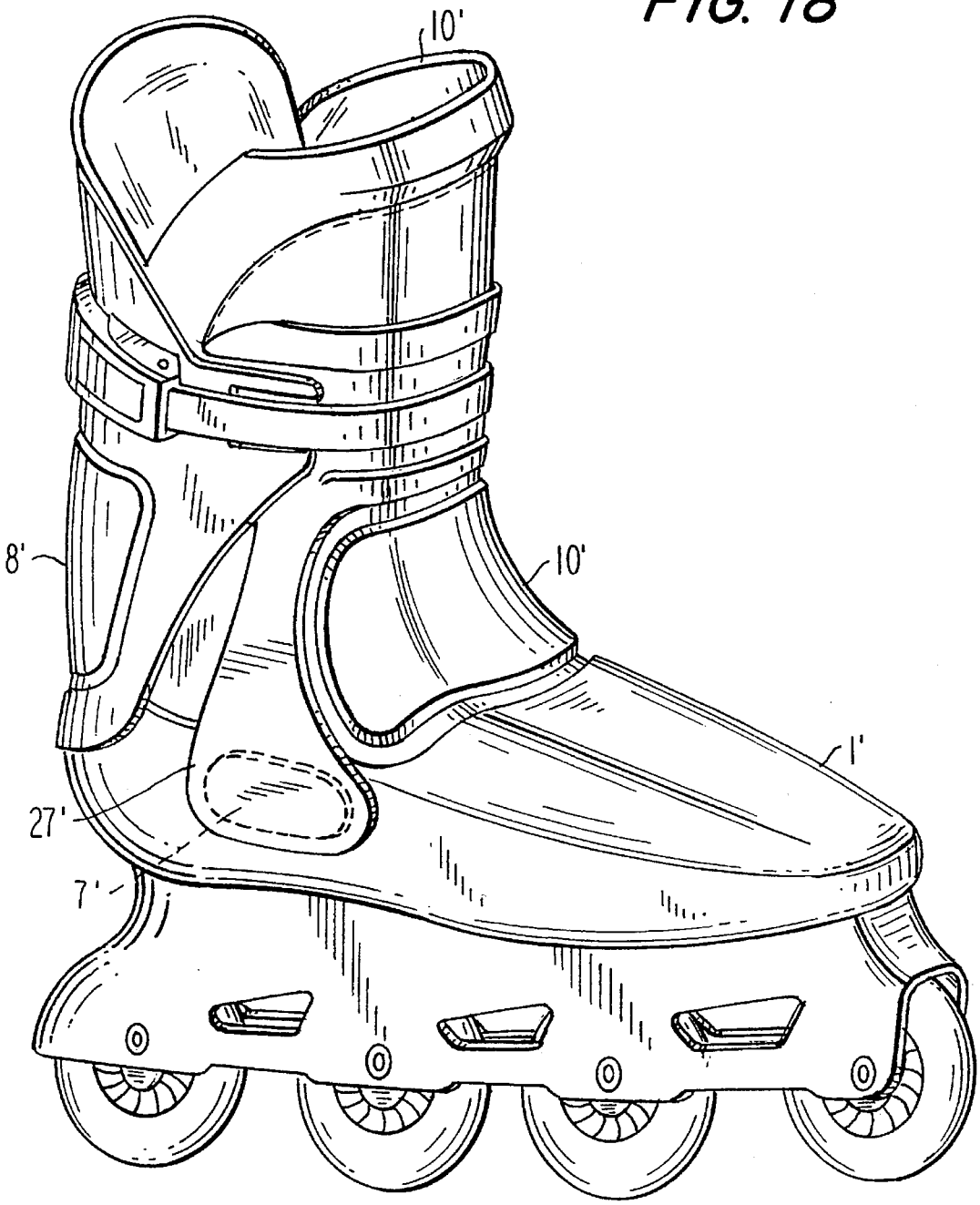
FIG. 18 is a perspective view of still another embodiment of the in-line skate construction of the present invention using an exoskeletal cuff member.

Another in-line skate boot construction is shown in FIG. 18. In this construction, an exoskeletal cuff member 27' is employed. The cuff member is attached to the shell member 1' by elastomeric material 7'. The elastomeric material has an oval shape in this embodiment of the invention. With the exoskeletal cuff construction, the inner boot 10' will be exposed in the front ankle portion of the boot.

The boot for the in-line skate of the embodiment of FIG. 17 also includes a front tongue member 29. This tongue member has the construction as disclosed in U.S. Pat. No. 4,281,468, the disclosure of which is incorporated herein by reference.

Figures 19, 20, 21:
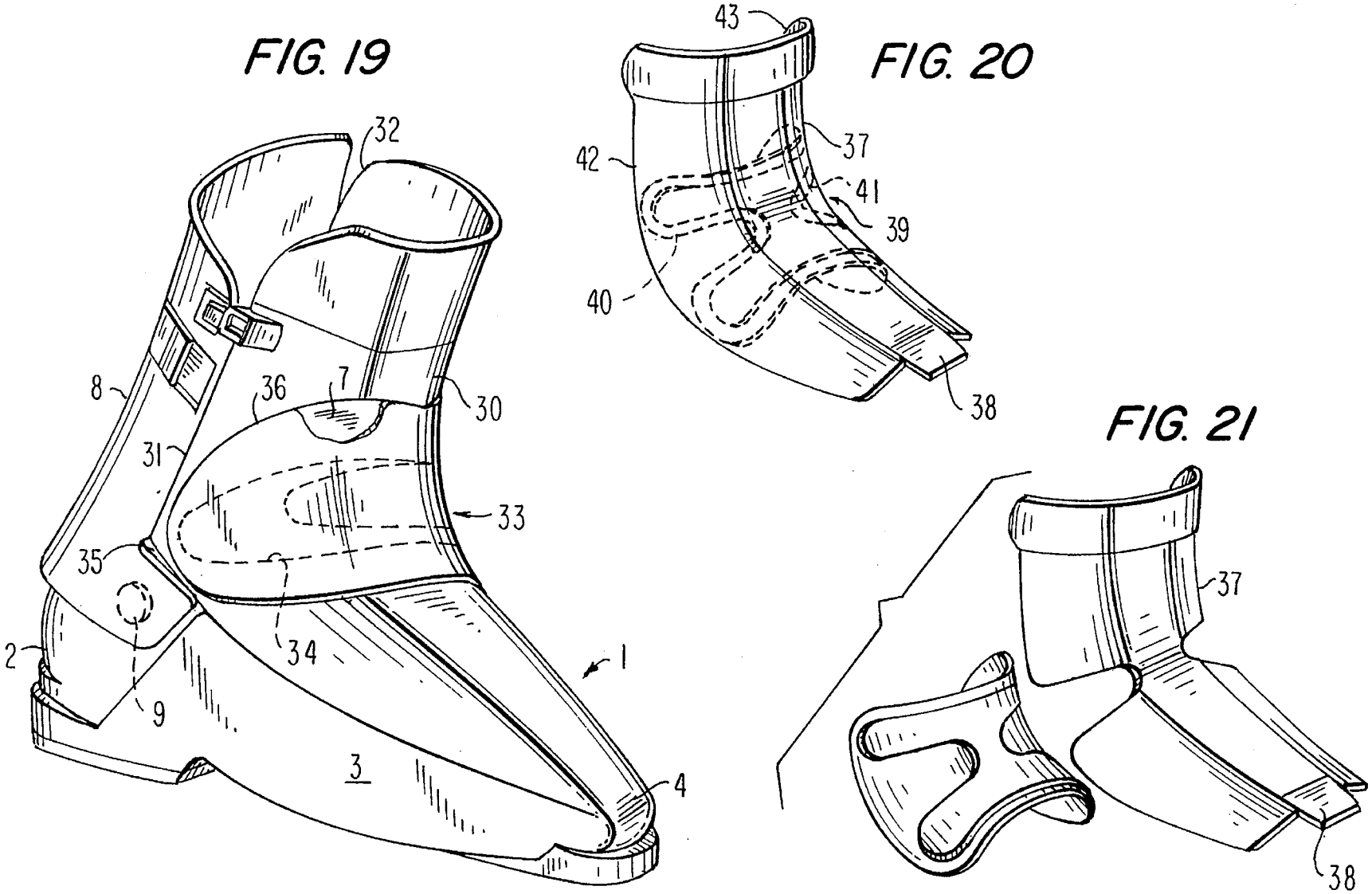
FIG. 19 is a perspective view of another embodiment of the invention in which the boot includes a tongue section having a reduced pivot area and associated elastomeric material.
FIG. 20 is a perspective view of a modified tongue section for the boot of the embodiment of FIG. 19.
FIG. 21 is an exploded view of the tongue section shown in FIG. 20.

The boot construction of FIG. 19 includes a shell 1 and rear cuff member 8. In addition, a tongue section 30 is connected to the front portion of the shell member and extends upwardly across the ankle and lower leg portion of the individual. The tongue section has opposite side edges 31, 32 which are spaced from each other to define a predetermined tongue width. The tongue section has a reduced width in the front of the ankle part of the individual's foot. This defines a pivot area 33. The pivot area permits pivoting of the tongue section relative to the front portion of the shell member. In the embodiment of FIG. 19, the reduced width of the tongue section in the pivot area is created by providing an opening 34 in the tongue section. The reduced width is thereby formed in the side areas 35 of the tongue member. Only one side area is shown in FIG. 19. It is understood, however, that there will be another such area on the hidden side of the boot.

In place of the front cuff member of the embodiment of FIGS. 1–4, a support member 36 is provided in the embodiment of FIG. 19. The support member overlaps the pivot area 33 of the shell member. Elastomeric material 7 is disposed between the tongue section and the support member. Opposite sides of the elastomeric material are connected to the tongue section and support member in any of the ways previously described. As shown in FIG. 19, the elastomeric material surrounds the opening 34 to permit the tongue section to flex and pivot forwardly with respect to the front portion of the shell member.

FIGS. 20 and 21 disclose another embodiment of the invention employing a tongue section 37 having a front end attached to the front portion 4 of the shell member. A pivot area 39 is provided in the construction shown in FIGS. 20, 21 by cut outs 40, 41 extending inwardly toward each other from opposite side edges 42, 43 of the tongue section. A support member 44 is disposed underneath the tongue section in the pivot area 39. It is connected to the tongue section by means of the elastomeric material 7. As shown in FIGS. 20 and 21, the elastomeric material 7 surrounds the cut outs 40, 41 inwardly of the opposite edges 42, 43 of the tongue section.

Figure 22:
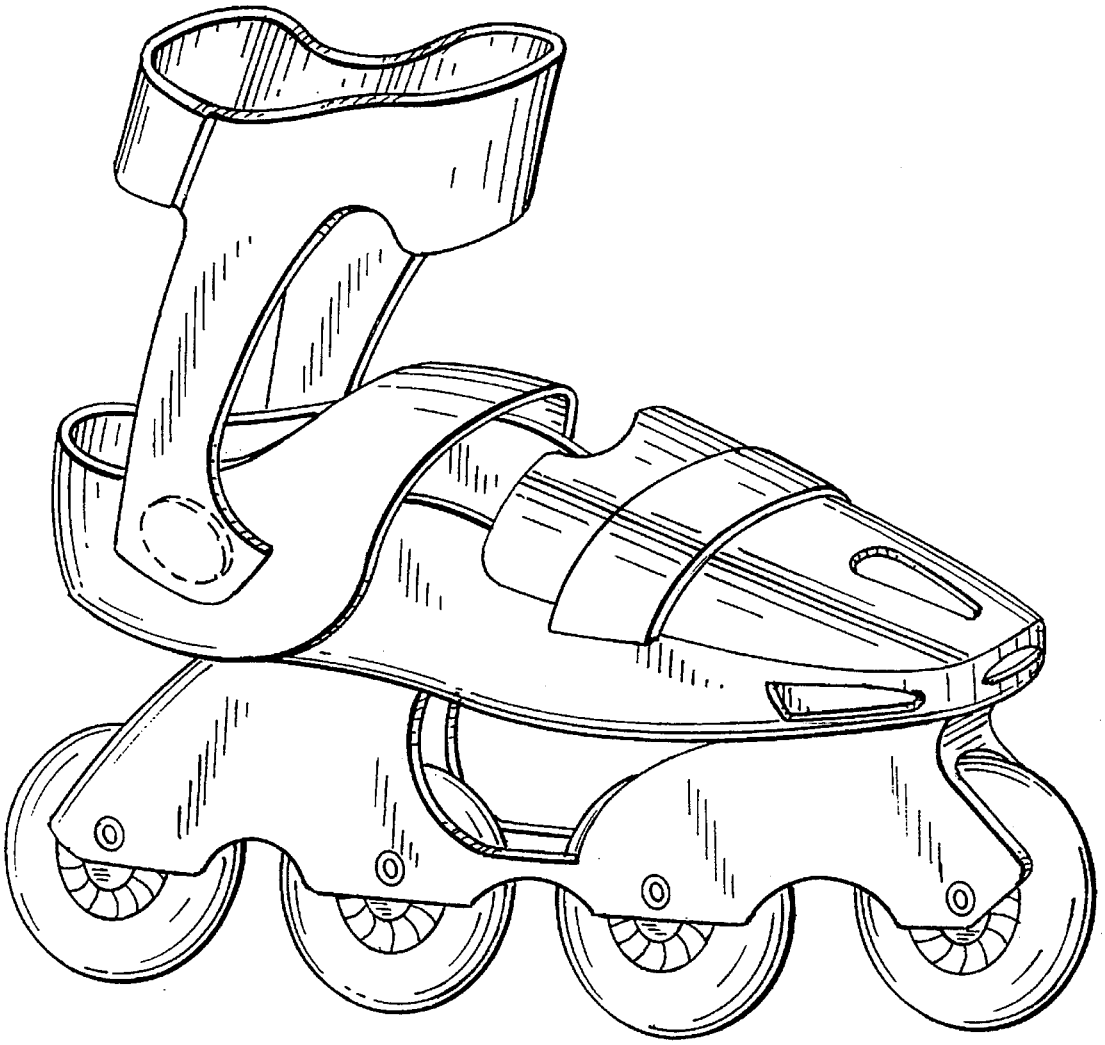
FIG. 22 is a perspective view of still another embodiment of an in-line skate construction similar to that of FIG. 18 and employing an exoskeletal cuff member.

Finally, FIG. 22 shows another construction of an in-line skate using an exoskeletal cuff member 44. As with the embodiment of FIG. 18, the exoskeletal cuff member 14 is attached to the shell member 1' by elastomeric material 7'. The embodiment of FIG. 22 differs from that of FIG. 18 in that no front tongue and inner boot is employed. Instead, padding 45 is provided on the inner surface of the upper portion of the exoskeletal cuff member and closure straps 46 extend across the top of the shell member 1' for holding the individual's foot within the shell member. In addition, a protective cover plate 47 is provided across the front end of the shell member 1'.

We claim:

1. The improvement in a boot having a first shoe shaped shell member with a heel, middle and front portion for receiving and supporting an individual's foot along at least the bottom, sides and top front portions of the foot, a second member having a section overlapping the shell member with a surface of said second member facing a surface of said shell member, said second member extending upwardly from the shell member for covering a portion of the individual's leg and being pivotally connected to the shell member for pivoting movement thereon in response to pivoting of the individual's leg relative to the individual's foot; and attaching means for pivotally attaching the second member to the shell member; the improvement wherein said attaching means includes:

a) an elastomeric material disposed between said shell member and the overlapping section of said second member, said elastomeric material having opposite sides, with a first side facing said surface of said shell member and a second side facing said surface of said second member;

b) connecting means for connecting said first side of said elastomeric material to said shell and said second side to said second member for movement of said first and second sides of the elastomeric material relative to each other in a direction extending along said surfaces of said shell member and said second member; and c) said elastomeric material including physical characteristics permitting said first and second sides thereof to rotate and shift laterally at the same time with respect to each other during pivoting of said second member on said shell member and said first and second sides of said elastomeric material are connected, respectively, to the surfaces of said shell and second member so as to define a floating pivot axis for said pivoting.

2. The boot according to claim 1 wherein:

a) the elastomeric material is shaped with an outer lateral periphery of predetermined shape and a thickness, as measured between said first and second sides which is a fraction of the distance laterally across either of said first and second sides.

3. The boot according to claim 1 wherein:

a) the second member is a cuff member which includes an overlapping section on either side of said shell in the area of the ankle bone of the individual's foot;

b) a connecting means connects said cuff member to said shell member at each of said overlapping sections; and c) an elastomeric material is disposed between each of the overlapping sections of said cuff member and said shell member.

4. The boot according to claim 3 wherein:

a) each of said elastomeric materials is disc shaped to define a circular outer periphery.

5. The boot according to claim 3 wherein:

a) each of said elastomeric materials is L-shaped with a first leg of the L extending toward said heel portion and a second leg extending toward said front portion of the boot.

6. The boot according to claim 3 wherein:

a) the connecting means includes separate connectors fixed to said first and second sides of said elastomeric material; and b) said shell and cuff members each include apertures for receiving said connectors to connect said elastomeric material to said shell and cuff members.

7. The boot according to claim 6 wherein:

a) the elastomeric material is bonded between plate members of predetermined stiffness no greater than the stiffness of said shell and cuff members; and b) said connecting means are fixed to said plate members against separation from said elastomeric material.

8. The boot according to claim 3 wherein:

a) the connecting means includes at least one connector extending into said elastomeric material from the first side thereof and at least a second connector extending into said second side thereof at a location spaced from said one connector, with said first connector being connected to said shell and said second connector being connected to said cuff member.

9. The boot according to claim 8 wherein:

a) the shell and cuff members each include an aperture for receiving each of said connectors.

10. The boot according to claim 3 wherein:

a) the first side of said elastomeric material is bonded to said surface of said shell member and the second side thereof to said surface of said cuff member.

11. The boot according to claim 3 wherein:

a) at least one of said shell and cuff members includes a recess in said surface thereof; and b) said elastomeric material extends into said recess to connect said material to said one member.

12. The boot according to claim 3 wherein:

a) the cuff member includes first overlapping sections on either side of said shell in the area of the ankle bone of the individual's foot and a second overlapping section between said first overlapping sections, said second overlapping section extending toward said front portion of said shell; and b) said elastomeric material is disposed between said cuff and shell members at both said first and said second overlapping section.

13. The boot according to claim 1 wherein:

a) said shell member includes a tongue section having opposite side edges spaced from each other to define a predetermined tongue width, said tongue member extending upwardly from said front portion of the shell member and having a reduced width, less than said predetermined width, in front of the ankle part of the individual's foot to define a pivot area permitting pivoting of the tongue section relative to the front portion of the shell member; and b) the second member is a support member overlapping the pivot area of said shell member, with said elastomeric material disposed therebetween.

14. The boot according to claim 13 wherein:

a) said reduced width of said pivot area is defined by an opening in said tongue section; and b) said elastomeric material surrounds said opening.

15. The boot according to claim 13 wherein:

a) said reduced width of said pivot area is defined by cutouts extending inwardly toward each other from said opposite side edges of said tongue section; and b) said elastomeric material surrounds said cutouts inwardly of said opposite side edges.

16. The boot according to claim 1 wherein:

a) the elastomeric material is a mixture of an isocyanate terminated urethane prepolymer and an aliphatic poyol blend.

17. The boot according to claim 1 wherein:

a) the elastomeric material is a polyether polyurethane.

18. The boot according to claim 1 wherein:

a) the elastomeric material is a mixture of an isocyanate terminated urethane prepolymer and a high molecular weight polytetra-methylene ether glycol mixed with a tri-functional curative.

19. The boot according to claim 18 wherein:

a) the prepolymer is diphenylmethane di isocyanate and a high molecular weight polytetra-methylene ether glycol.

20. The boot according to claim 1 wherein the elastomeric material has the following physical characteristics:

| | |
|---|---|
| Durometer | 30–85 Shore A |
| Bayshore rebound | 30–85% |
| split tear | 15–200 psi. |
| 100% modulus | 50–1000 psi. |
| 300% modulus | 100–3000 psi. |
| 500% modulus | 150–5000 psi. |
| tensile | 1000–5500 psi. |
| elongation | 200–800% |
| compression set | 1–50%. |

21. The boot according to claim 20 wherein the elastomeric material has the following physical characteristics:

| | |
|---|---|
| Durometer | 49 Shore A |
| Bayshore rebound | 75% |
| split tear | 45 psi. |
| 100% modulus | 192 psi. |
| 300% modulus | 224 psi. |
| 500% modulus | 256 psi. |
| ultimate tensile | 1280 psi. |
| ultimate elongation | 750% |
| compression set | 30%. |

* * * * *